US009065190B2

(12) United States Patent
Kuwayama

(10) Patent No.: US 9,065,190 B2
(45) Date of Patent: Jun. 23, 2015

(54) CRIMP TERMINAL, CRIMP STRUCTURE OF CRIMP TERMINAL, AND CRIMPING METHOD OF CRIMP TERMINAL

(75) Inventors: Yasumichi Kuwayama, Makinohara (JP); Goro Kuwayama, legal representative, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 330 days.

(21) Appl. No.: 13/257,808

(22) PCT Filed: Apr. 7, 2010

(86) PCT No.: PCT/JP2010/056319

§ 371 (c)(1),
(2), (4) Date: Sep. 20, 2011

(87) PCT Pub. No.: WO2010/117019

PCT Pub. Date: Oct. 14, 2010

(65) Prior Publication Data

US 2012/0006596 A1 Jan. 12, 2012

(30) Foreign Application Priority Data

Apr. 7, 2009 (JP) ..... 2009-093145

(51) Int. Cl.
*H01R 4/18* (2006.01)
*H01R 43/048* (2006.01)

(52) U.S. Cl.
CPC ..... *H01R 4/188* (2013.01); *Y10T 29/49185* (2013.01); *H01R 43/048* (2013.01)

(58) Field of Classification Search
USPC ..... 174/84 C; 439/877
See application file for complete search history.

(56) References Cited

U.S. PATENT DOCUMENTS 5,913,695 A 6/1999 Okabe
6,736,664 B2 * 5/2004 Ueda et al. ..... 439/423
(Continued)

FOREIGN PATENT DOCUMENTS

CN 1591979 A 3/2005
EP 1071174 A2 1/2001
(Continued)

OTHER PUBLICATIONS

International Search Report [PCT/ISA/210], dated May 18, 2010, from the International Searching Authority, issued in Application No. PCT/JP2010/056319.
(Continued)

*Primary Examiner* — Chau N Nguyen
(74) *Attorney, Agent, or Firm* — Sughrue Mion, PLLC

(57) ABSTRACT

An object is to provide a crimp terminal which can increase contact pressure at both sides of a conductor press-clamping portion by reducing difficulty with which an original crimped shape is restored after a thermal shock test by realizing an increase in rigidity at root portions of conductor clamping pieces. In a crimp terminal (10) in which a conductor press-clamping portion (12) is provided rearwards of an electrical connecting portion (11) and a sheath clamping portion (13, 32) is provided rearwards of the conductor press-clamping portion (12), and the conductor press-clamping portion is formed into a configuration having a substantially U-shaped cross section by a bottom plate (31) and a pair of conductor clamping pieces (32) which extend upwards from left- and right-hand side edges of the bottom plate (31), reinforcement concave-convex portions (40) of a limited size are formed at respective root portions of the pair of conductor clamping pieces (32, 32) in which either an inner surface side or an outer surface side of the conductor clamping piece (32) is formed into a depressed portion (41) and the other is formed into a projection portion (42).

3 Claims, 8 Drawing Sheets

(56) References Cited

U.S. PATENT DOCUMENTS

| | | | | |
|---|---|---|---|---|
| 7,306,495 | B2 | 12/2007 | Hashimoto et al. | |
| 7,462,081 | B2 * | 12/2008 | Kato et al. | 439/877 |
| 7,901,257 | B2 * | 3/2011 | Okamura et al. | 439/877 |
| 2005/0026515 | A1 | 2/2005 | Hashimoto et al. | |
| 2007/0111613 | A1 | 5/2007 | Kumakura | |

FOREIGN PATENT DOCUMENTS

| | | |
|---|---|---|
| JP | 489285 | 2/1973 |
| JP | 55-120079 | 8/1980 |
| JP | 2004-303526 A | 10/2004 |

OTHER PUBLICATIONS

Written Opinion [PCT/ISA/237], dated May 18, 2010, from the International Searching Authority, issued in Application No. PCT/JP2010/056319.

Office Action and Search Report dated Jul. 24, 2013 issued by the State Intellectual Property Office of the People's Republic of China in counterpart Chinese Application No. 201080015731.3.

Office Action dated Jun. 25, 2013 issued by the Japanese Patent Office in counterpart Japanese Application No. 2009093145.

Extended European Search Report dated Dec. 20, 2013, issued by the European Patent Office in corresponding European Application No. 10761718.5.

Office Action dated Apr. 3, 2014 issued by the State Intellectual Property Office of the People's Republic of China in counterpart Chinese Patent Application No. 201080015731.3.

Communication, Issued by the State Intellectual Property Office of P.R. China, Dated Sep. 18, 2014, in counterpart Chinese Application No. 201080015731.3.

Office Action dated Mar. 16, 2015 issued by the State Intellectual Property Office of the People's Republic of China in counterpart Chinese Application No. 201080015731.3.

* cited by examiner (Prior Art)

(a)

(b)

(Prior Art)

CRIMP TERMINAL, CRIMP STRUCTURE OF CRIMP TERMINAL, AND CRIMPING METHOD OF CRIMP TERMINAL

TECHNICAL FIELD

The present invention relates to an open barrel type crimp terminal having a conductor press-clamping portion with a U-shaped cross section which is used in, for example, an automotive electric system, a crimp structure of an open barrel type crimp terminal and a crimping method of an open barrel type crimp terminal.

BACKGROUND ART

FIG. 12 is a perspective view showing the configuration of a crimp terminal in a related art which is similar to one described in Patent Literature 1, for example.

This crimp terminal 210 includes an electrical connecting portion 211 adapted to be connected to a terminal of a mating connector at a front portion in a longitudinal direction of the terminal (also a longitudinal direction of an electric wire to be connected thereto), additionally includes a conductor press-clamping portion 212 adapted to be crimped against a bared conductor at an end of an electric wire (whose illustration is omitted) at a portion lying rearwards of the electrical connecting portion 211 and further includes a sheath clamping portion 213 adapted to be crimped against an insulation sheath portion of the electric wire at a portion lying rearwards of the conductor press-clamping portion 212. In addition, the crimp terminal 210 includes a first connecting portion 214 lying between the electrical connecting portion 211 and the conductor press-clamping portion 212 to connect these two portions together, and a second connecting portion 215 lying between the conductor press-clamping portion 212 and the sheath clamping portion 213 to connect these two portions together.

The conductor press-clamping portion 212 is formed into a configuration having a substantially U-shaped cross section by a bottom plate 231 and a pair of conductor clamping pieces 232, 232 which extend upwards from left- and right-hand side edges of the bottom plate 231 to be crimped so as to wrap the conductor of the electric wire which is disposed on an inner surface of the bottom plate 231. In addition, the sheath clamping portion 213 is formed into a configuration having a substantially U-shaped cross section by a bottom plate 261 and a pair of sheath clamping pieces 262, 262 which extend upwards from left- and right-hand side edges of the base plate 261 to be crimped against (the insulation sheath portion of) the electric wire which is disposed on an inner surface of the bottom plate 261.

The first connecting portion 214 and the second connecting portion 215 which are formed at the front and rear of the conductor press-clamping portion 212 are both formed into configurations having a substantially U-shaped cross section by bottom plates 221, 251 and low side plates 222, 252 which are erected from left- and right-hand side edges of the bottom plates 221, 251.

Then, a bottom plate (not shown) of the electrical connecting portion 211 at a front portion and the bottom plates 221, 231, 251, 261 through the sheath clamping portion 213 at the rearmost portion are formed continuously like a single belt-shaped plate. In addition, front and rear ends of the low side plates 222 of the first connecting portion 214 connect, respectively, to lower half portions of rear ends of side plates (whose reference numerals are omitted) of the electrical connecting portion 211 and front ends of the conductor clamping pieces 232 of the conductor press-clamping portion 212. Front and rear ends of the low side plates 252 of the second connecting portion 215 connect, respectively, to lower half portions of rear ends of the conductor clamping pieces 232 of the conductor press-clamping portion 212 and front ends of the sheath clamping pieces 262 of the sheath clamping portion 213.

A plurality of recessed groove-like serrations 235, which extend in a direction which is at right angles to the longitudinal direction of the conductor of the electric wire (the longitudinal direction of the terminal), are provided on an inner surface of the conductor press-clamping portion 212.

To crimp the conductor press-clamping portion 212 of the crimp terminal 210 against the conductor at the end of the electric wire, the crimp terminal 210 is placed on a placing surface (an upper surface) of a lower mold (an anvil), not shown, and the conductor at the end of the electric wire is inserted between the conductor clamping pieces 232 of the conductor press-clamping portion 212 to thereby be placed on an upper surface of the bottom plate 231. Then, an upper mold (a crimper) is lowered relative to the lower mold to thereby bring down distal end portions of the conductor clamping pieces 232 gradually inwards by sloping guide planes of the upper mold. As this occurs, the left and right conductor clamping pieces 232 are bent to be deformed about portions lying in proximity to left and right edge portions 231*a* of the bottom plate 231.

Then, by lowering the upper mold (the crimper) further downwards relative to the lower mold, the distal ends of the conductor clamping pieces 232 are finally rounded in a folded back fashion by curved planes of the upper mold which connect from the sloping guide planes to a central angular portion thereof, whereby the conductor clamping pieces 232 are crimped so as to wrap the conductor Wa by causing the distal ends of the conductor clamping pieces 232 to bite into the conductor Wa while causing them to rub against each other, as is shown in (a) of FIG. 13.

By the series of operations, the conductor press-clamping portion 212 of the crimp terminal 210 can be connected to the conductor Wa of the electric wire through crimping. Also, with respect to the sheath clamping portion 213, the sheath clamping pieces 262 are bent gradually inwards by use of the upper and lower molds in a similar fashion and the sheath clamping pieces 262 are crimped against the insulation sheath portion of the electric wire. By doing this, the crimp terminal 210 can be connected to the electric wire electrically and mechanically.

Incidentally, when the crimp terminal 210 is connected to the electric wire in the way described above, the reliability of the crimped portions need to be evaluated, and to make this happen, thermal shock tests are performed from time to time.

A thermal shock test is performed to inspect a durability in severe conditions which can cover all service conditions which are considered to occur in reality. For example, in the case of crimped portions of an automotive terminal, the crimped portions are repeatedly subjected to low-temperature conditions and high-temperature conditions.

When a thermal shock test like this is performed on the crimp terminal 210, the conductor press-clamping portion 212 of the crimp terminal 210 and the conductor Wa of the electric wire expand or contract (expand or shrink). For example, assuming that a shape indicated by solid lines in (a) of FIG. 13 shows a state at ordinary temperatures, the conductor press-clamping portion 212 expands to a shape indicated by dotted lines at high temperatures.

When the rigidity of the conductor press-clamping portion 212 is sufficiently high, even in the event that the conductor press-clamping portion 212 and the conductor Wa expand or contract in accordance with a change in temperature, the conductor press-clamping portion 212 restores its original crimped shape at ordinary temperatures. However, in the case of a terminal which is made small in size or thin in thickness, the rigidity of the terminal tends to decrease, and therefore, the shape of a conductor press-clamping portion is made difficult to restore its original crimped shape after such a thermal shock test has been carried out thereon, and there may occur a case where the conductor press-clamping portion cannot restore its original crimped shape completely as is shown in (b) of FIG. 13. Namely, there may occur a case where a portion of the conductor press-clamping portion where distal ends of left and right conductor clamping pieces 232 rub against each other tends to open and cannot be restored completely to its original condition.

For example, as is indicated by the solid lines in (a) of FIG. 13, when crimped, the distal ends of the conductor clamping pieces 232 of the conductor press-clamping portion 212 bite into the conductor Wa. However, when a biting amount e1 of the distal ends of the conductor clamping pieces 232 is not so large (when a biting depth of the distal ends is shallow), a phenomenon tends to occur easily in which the conductor clamping pieces 232 do not restore their original crimped shapes completely after the thermal shock test is carried out thereon, as a result of which as is shown by a dimension e2 in (b) of FIG. 13, there may occur a situation in which the biting depth becomes shallower.

In this way, when the conductor clamping pieces 232 are made difficult to restore their original crimped shapes, whereby the portion where the distal ends of the conductor clamping portions 232 tends to open or the biting depth of the conductor clamping pieces 232 into the conductor Wa becomes shallow, the clamping of the conductor Wa by the conductor clamping pieces 232 becomes weak, whereby a contact pressure (a contact load) F to the conductor Wa exerted by the conductor clamping pieces 232 is reduced. When the contact pressure F is reduced, a securing force (a mechanical connecting force) and an electrical conductivity (an electrical connection property) at the connecting portion between the crimp terminal 210 and the electric wire are reduced.

On the other hand, in recent years, to reduce the weight of a wiring harness, the replacement of copper electric wires with aluminum electric wires is now studied, and actually, there are many cases where a copper terminal is connected to an aluminum electric wire. However, it has been found that in such a case, due to there being a difference in thermal expansion between the crimp terminal and the conductor, the contact pressure between the crimp terminal and the conductor tends to be reduced further.

CITATION LIST

Patent Literature

Patent Literature 1: JP-A-2004-303526 (FIG. 1)

SUMMARY OF THE INVENTION

Technical Problem

As has been described above, in the case of the crimp terminal 210 which is made small in size and thin in thickness, there has occurred from time to time a case where due to the insufficient rigidity of the conductor press-clamping portion 212, the electrical connection property and the mechanical connection property of the crimped portion against the conductor are reduced.

Then, the inventor and others have made deep studies on this point to find that when the conductor clamping pieces 232 are made difficult to restore their original crimped shapes, the clamping of the conductor Wa from the left- and right-hand sides thereof gets weak and the contact pressures at both the edges of the crimped portion are reduced, which constitutes a largest cause for the reduction in electrical connection property and mechanical connection property. In addition, it has also been found that the rigidities at root portions of the conductor clamping pieces 232 which are indicated by circles denoted by X in (b) of FIG. 13 affect most the reduction in contact pressure at both the edges of the crimped portion.

In view of these situations, an object of the invention is to provide a crimp terminal, a crimp structure of the crimp terminal and a crimping method for crimping the crimp terminal in which the difficulty with which a crimped portion restores its original crimped shape after a thermal shock test can be reduced by increasing rigidities particularly at root portions of conductor clamping pieces, whereby contact pressures at both edges of a conductor press-clamping portion can be increased effectively, as a result of which both an electrical connection property and a mechanical connection property can be increased.

Solution to Problem

In order to solve the problem, a crimp terminal according to a first aspect of the invention is configured by including a conductor press-clamping portion which is to be crimped against and connected to a conductor of an electric wire, the conductor press-clamping portion being formed into a configuration having a substantially U-shaped cross section by a bottom plate and a pair of conductor clamping pieces which extend upwards from left- and right-hand edges of the bottom plate and which are to be crimped so as to wrap the conductor disposed on an inner surface of the bottom plate, wherein reinforcement concave-convex portions of a limited size are formed at respective root portions of the pair of conductor clamping pieces in each of which an inner surface side or an outer surface side of each of the conductor clamping pieces is formed into a depressed portion and the other is formed into a projecting portion.

A crimp structure of a crimp terminal according to a second aspect of the invention is configured by including a conductor press-clamping portion which is to be crimped against and connected to a conductor of an electric wire, the conductor press-clamping portion being formed into a configuration having a substantially U-shaped cross section by a bottom plate and a pair of conductor clamping pieces which extend upwards from left- and right-hand edges of the bottom plate, wherein the crimp structure is configured so that the conductor press-clamping portion is crimped against the conductor by disposing the conductor on an inner surface of the bottom plate and bending the pair of conductor clamping pieces inwards to crimp them against the conductor so as to wrap the conductor, wherein reinforcement concave-convex portions of a limited size are formed at respective root portions of the pair of conductor clamping pieces in each of which either an inner surface side or an outer surface side of each of the conductor clamping pieces is formed into a depressed portion and the other is formed into a projecting portion.

A crimping method of a crimp terminal according to a third aspect of the invention is configured by including placing a crimp terminal including a conductor press-clamping portion which is to be crimped against and connected to a conductor of an electric wire, the conductor press-clamping portion being formed into a configuration having a substantially U-shaped cross section by a bottom plate and a pair of conductor clamping pieces which extend upwards from left- and right-hand edges of the bottom plate on a placing surface of a lower mold of a crimping apparatus having an upper mold and the lower mold; inserting a conductor at an end of the electric wire between the pair of left and right conductor clamping pieces of the conductor press-clamping portion so as to be placed on an inner surface of the bottom plate; and lowering, in that state, the upper mold relative to the lower mold to thereby bend the pair of conductor clamping pieces inwards to crimp them against the conductor so as to wrap the conductor whereby the conductor press-clamping portion is crimped against the conductor, wherein, in crimping the conductor press-clamping portion of the crimp terminal against the conductor of the electric wire by the upper mold and the lower mold, at the same time, reinforcement concave-convex portions of a limited size are formed at respective root portions of the pair of conductor clamping pieces in each of which an inner surface side and an outer surface side of each of the conductor clamping pieces are formed into a projecting portion and a depressed portion, respectively, by press-working the root portions with projections projected on the placing surface of the lower mold.

DESCRIPTION OF THE EMBODIMENT

Hereinafter, embodiments of the invention will be described by reference to the drawings.

Figure 1:
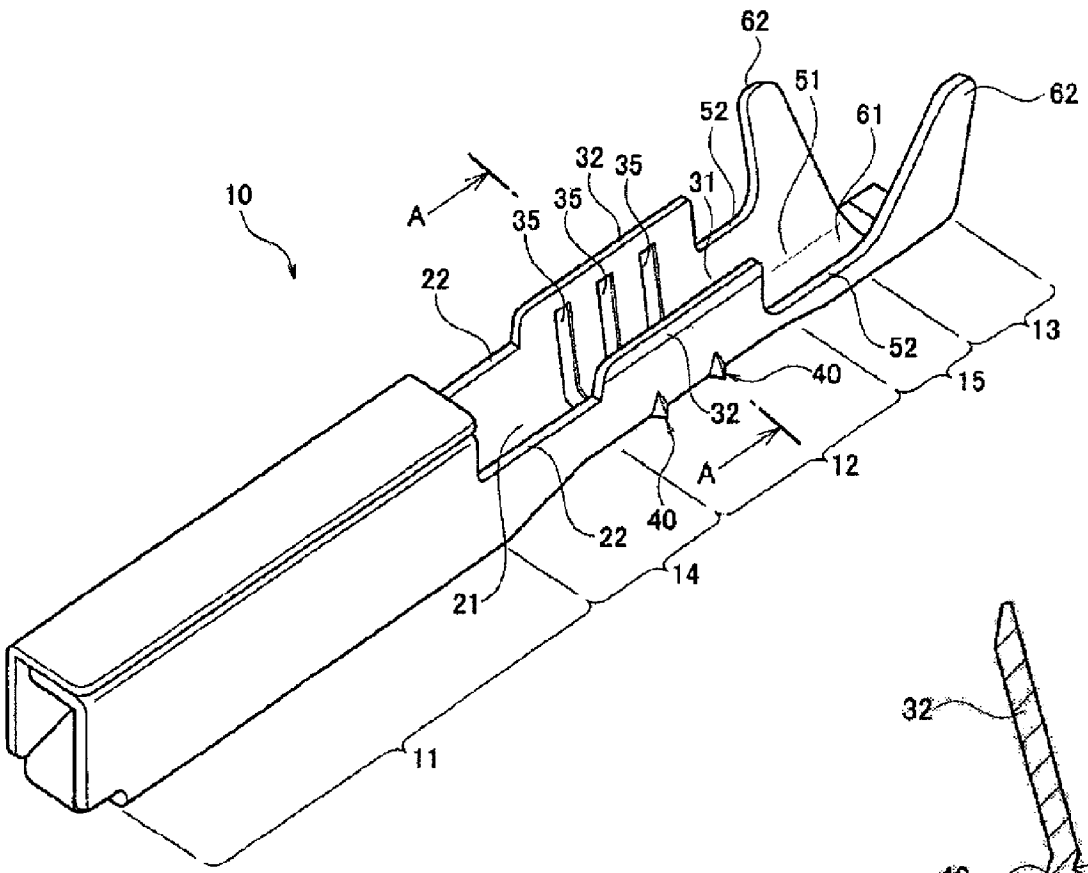
FIG. 1 is a perspective view showing the configuration of a crimp terminal according to a first embodiment of the invention.
Figure 2:
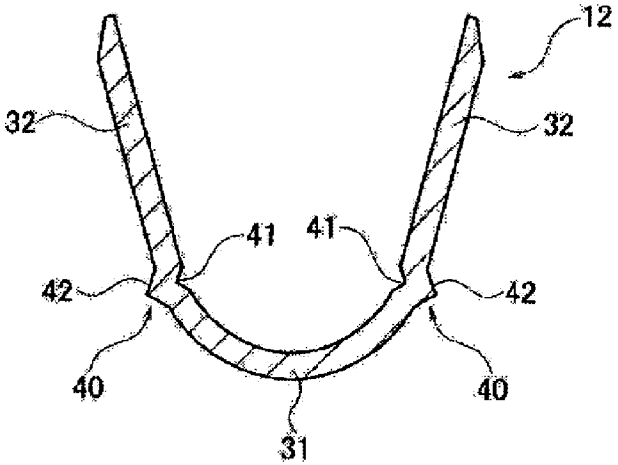
FIG. 2 is a sectional view taken along a line A-A and viewed in a direction indicated by arrows in FIG. 1.
Figure 3:
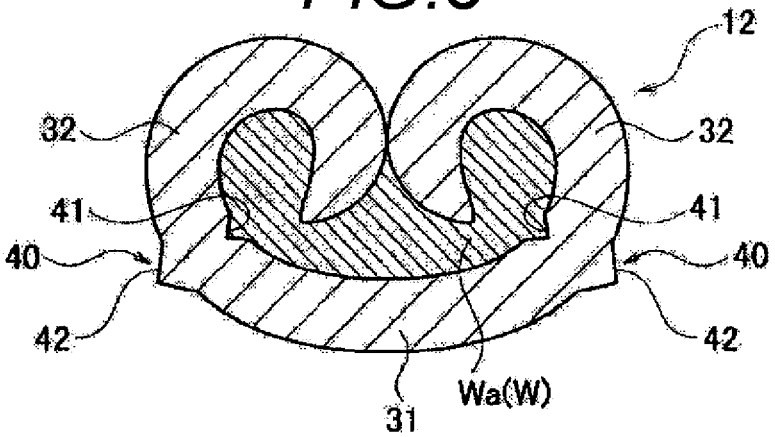
FIG. 3 is a sectional view of a portion where a conductor press-clamping portion of the crimp terminal is crimped against a conductor of an electric wire.
Figure 4:
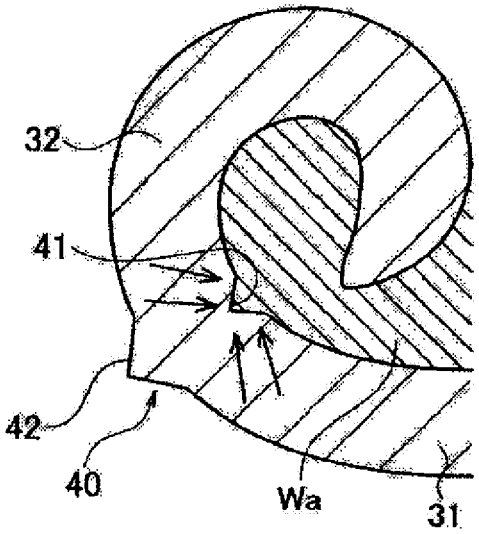
FIG. 4 is an enlarged view of a main part of FIG. 3.

FIG. 1 is a perspective view showing the configuration of a crimp terminal according to a first embodiment of the invention, FIG. 2 is a sectional view taken along a line A-A and viewed in a direction indicated by arrows in FIG. 1, FIG. 3 is a sectional view of a portion where a conductor press-clamping portion of the crimp terminal is crimped against a conductor of an electric wire, and FIG. 4 is an enlarged view of a main part of FIG. 3.

As is shown in FIG. 1, a crimp terminal 10 includes an electrical connecting portion 11 adapted to be connected to a terminal of a mating connector at a front portion in a longitudinal direction of the terminal (also a longitudinal direction of an electric wire to be connected thereto), additionally includes a conductor press-clamping portion 12 adapted to be crimped against a bared conductor Wa (refer to FIGS. 3 and 4) at an end of an electric wire (whose illustration is omitted) at a portion lying rearwards of the electrical connecting portion 11 and further includes a sheath clamping portion 13 adapted to be crimped against an insulation sheath portion of the electric wire at a portion lying rearwards of the conductor press-clamping portion 12. In addition, the crimp terminal 10 includes a first connecting portion 14 lying between the electrical connecting portion 11 and the conductor press-clamping portion 12 to connect these two portions together, and a second connecting portion 15 lying between the conductor press-clamping portion 12 and the sheath clamping portion 13 to connect these two portions together.

The conductor press-clamping portion 12 is formed into a configuration having a substantially U-shaped cross section by a bottom plate 31 and a pair of conductor clamping pieces 32, 32 which extend upwards from left- and right-hand side edges of the bottom plate 31 to be crimped so as to wrap the conductor of the electric wire which is disposed on an inner surface of the bottom plate 31. In addition, the sheath clamping portion 13 is formed into a configuration having a substantially U-shaped cross section by a bottom plate 61 and a pair of sheath clamping pieces 62, 62 which extend upwards from left- and right-hand side edges of the base plate 61 to be crimped against (the insulation sheath portion of) the electric wire which is disposed on an inner surface of the bottom plate 61.

The first connecting portion 14 and the second connecting portion 15 which are formed at the front and rear of the conductor press-clamping portion 12 are both formed into configurations having a substantially U-shaped cross section by bottom plates 21, 51 and low side plates 22, 52 which are erected from left- and right-hand side edges of the bottom plates 21, 51.

Here, a bottom plate (not shown) of the electrical connecting portion 11 at the front portion and the bottom plates 21, 31, 51, 61 through the sheath clamping portion 13 at the rearmost portion are formed continuously like a single belt-shaped plate. In addition, front and rear ends of the low side plates 22 of the first connecting portion 14 connect, respectively, to lower half portions of rear ends of side plates (whose reference numerals are omitted) of the electrical connecting portion 11 and front ends of the conductor clamping pieces 32 of the conductor press-clamping portion 12. Front and rear ends of the low side plates 52 of the second connecting portion 15 connect, respectively, to lower half portions of rear ends of the conductor clamping pieces 32 of the conductor press-clamping portion 12 and front ends of the sheath clamping pieces 62 of the sheath clamping portion 13.

Further, in this crimp terminal 10, as is shown in FIGS. 1 to 4, a reinforcement concave-convex portion 40 is locally formed at a root portion (a portion which is likely to be bent with a smallest curvature when the pair of conductor clamping pieces 32, 32 are crimped) of each of the pair of conductor clamping pieces 32, 32 through press-working in which an inner surface side is formed into a pyramid-shaped depressed portion 41 and an outer side surface is formed into a pyramid-shaped projecting portion 42. In this case, a plurality of reinforcement concave-convex portions 40 are provided on each root portion at appropriate intervals in a widthwise direction of the conductor clamping piece 32 (in the longitudinal direction of the terminal).

Three recessed groove-like serrations 35, which extend in a direction which is at right angles to the longitudinal direction of the terminal, are provided on an inner surface of the conductor press-clamping portion 12.

When crimping the conductor press-clamping portion 12 of the crimp terminal 10 against the conductor Wa at the end of the electric wire, firstly, the crimp terminal 10 is placed on a placing surface (an upper surface) of a lower mold (an anvil), not shown, and the conductor Wa at the end of the electric wire W is inserted between the conductor clamping pieces 32 of the conductor press-clamping portion 12 to thereby be placed on an upper surface of the bottom plate 31. Then, an upper mold is lowered relative to the lower mold to thereby bring down distal end portions of the conductor clamping pieces 32 gradually inwards by left and right sloping guide planes of the upper mold.

Then, by lowering the upper mold further downwards relative to the lower mold, the distal ends of the conductor clamping pieces 32 are finally rounded in a folded back fashion by curved planes of the upper mold which connect from the left and right sloping guide planes to a central angular portion thereof, whereby the conductor clamping pieces 32 are crimped so as to wrap the conductor Wa by causing the distal ends of the conductor clamping pieces 32 to bite into the conductor Wa of the electric wire W while causing them to rub against each other, as is shown in FIG. 3.

By the series of operations, the conductor press-clamping portion 12 of the crimp terminal 10 can be connected to the conductor Wa of the electric wire W, thereby making it possible to obtain a crimp structure shown in FIG. 3. Also, with respect to the sheath clamping portion 13, the sheath clamping pieces 62 are bent gradually inwards by use of the upper and lower molds in a similar fashion and the sheath clamping pieces 62 are crimped against the insulation sheath portion of the electric wire. By doing this, the crimp terminal 10 can be connected to the electric wire electrically and mechanically.

According to the crimp terminal 10 which is crimped in the way described above and the crimp structure obtained by the crimp terminal 10, since the reinforcement concave-convex portions 40 are provided at the respective root portions of the left and right conductor clamping pieces 32, the rigidities at the root portions of the conductor clamping pieces 32 can be increased, thereby making it possible to prevent the looseness of the crimped conductor clamping pieces 32 that would otherwise be caused by a thermal shock test which is carried out in such a state that the left and right conductor clamping pieces 32 are crimped against the conductor Wa of the electric wire W.

Namely, when the thermal shock test is performed on the portion where the conductor clamping pieces 32 of the crimp terminal 10 are crimped against the conductor Wa of the electric wire W, in the event that the rigidity of the conductor press-clamping portion 12 tends to be insufficient, the distal ends of the conductor clamping pieces 32 do not restore their original crimped shapes completely as a result of repetition of thermal expansion and thermal shrinkage when the conductor clamping pieces 32 get back to the ordinary temperature condition, whereby there may occur a case where the distal ends of the conductor clamping pieces 32 tends not to be closed completely but to remain slightly opened or the biting of the distal ends of the conductor clamping pieces 32 into the conductor Wa becomes shallow. In particular, when the terminal material differs from the conductor material, causing a difference in thermal expansion therebetween, the above phenomenon tends to occur easily. Then, the clamping force exerted on the electric wire W by the crimp terminal 10 is reduced, thereby electric connection resistance being increased or mechanical joining strength being weakened.

In this respect, in the crimp terminal 10 and the crimp structure according to the embodiment, due to the rigidity of the conductor clamping pieces 32 being reinforced by addition of the reinforcement concave-convex portions 40, the looseness of the crimped conductor clamping pieces 32 (that is, the phenomenon that the conductor clamping pieces 32 do not restore their original crimped shapes completely, whereby the distal ends of the conductor clamping pieces 32 tends not to be closed completely but to remain slightly opened or the biting of the distal ends of the conductor clamping pieces 32 into the conductor Wa becomes shallow) can be prevented which would otherwise be caused when the thermal shock test is carried out, thereby making it possible to realize an increase in electrical connection property and an increase in mechanical connection property. In addition, since the construction to make that happen results only from providing the reinforcement concave-convex portions 40 of the limited size at the root portions of the conductor clamping pieces 32, the construction can be realized without changing the shape of the terminal largely.

In addition, since the clamping force exerted on the conductor Wa by the conductor clamping pieces 32 can be expected to increase (pressures are applied as indicated by arrows in FIG. 4) in the positions where the reinforcement concave-convex portions 40 are provided and where the shape of the crimp terminal 10 is changed locally when the conductor clamping pieces 32 are crimped against the conductor Wa, an increase in contact pressure exerted on the conductor Wa by the conductor clamping pieces 32 can be realized in this respect.

Additionally, since the serrations 35 are provided in the inner surface of the conductor press-clamping portion 12 as with the crimp terminal in the related art, an increase in contact pressure between the crimp terminal 10 and the conductor Wa can be realized. In addition, in the case of the electric wire being an aluminum electric wire, an increase in adhering area between the crimp terminal 10 and the conductor Wa can be realized by the sliding of the aluminum conductor Wa against the serrations 35, thereby making it possible to realize an increase in electrical connection property and mechanical connection property.

Figure 5:
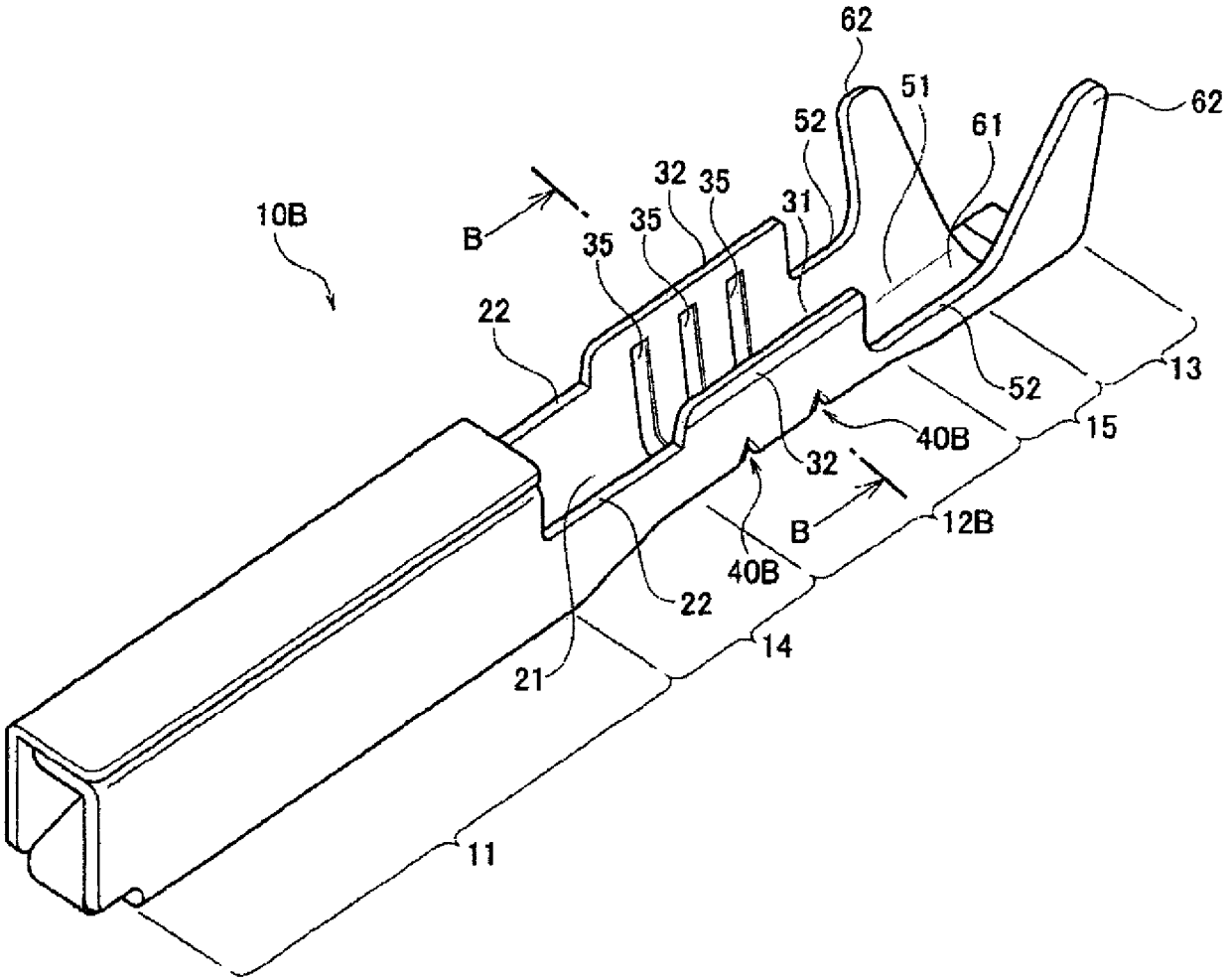
FIG. 5 is a perspective view showing the configuration of a crimp terminal according to a second embodiment of the invention.
Figure 6:
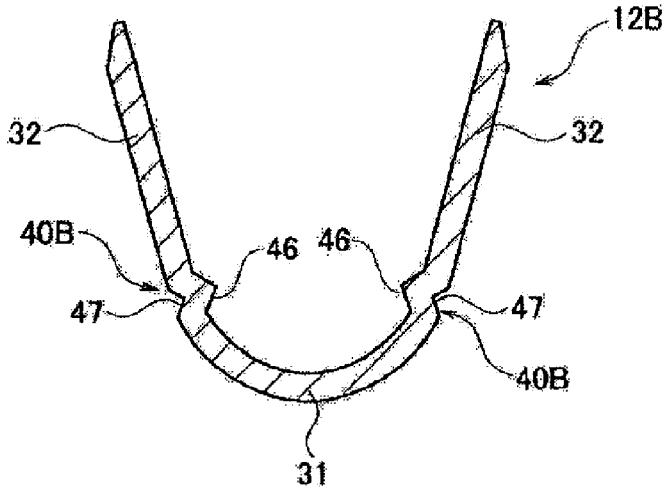
FIG. 6 is a sectional view taken along a line B-B and viewed in a direction indicated by arrows in FIG. 5.
Figure 7:
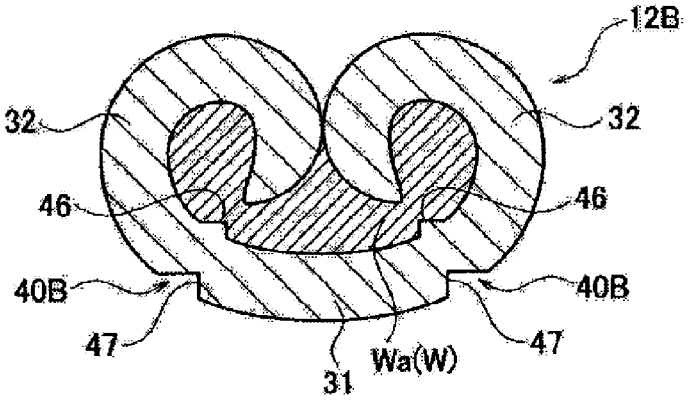
FIG. 7 is a sectional view of a portion where a conductor press-clamping portion of the crimp terminal is crimped against a conductor of an electric wire.
Figure 8:
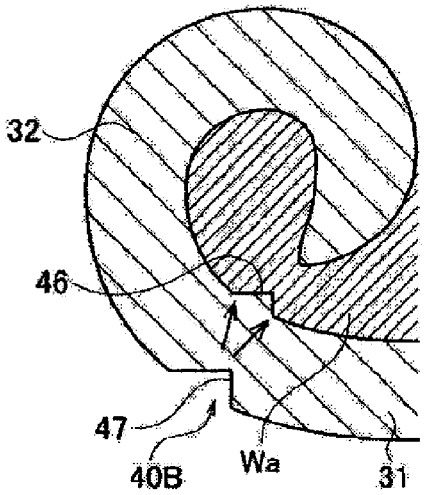
FIG. 8 is an enlarged view of a main part of FIG. 7.

FIG. 5 is a perspective view showing the configuration of a crimp terminal according to a second embodiment of the invention, FIG. 6 is a sectional view taken along a line B-B and viewed in a direction indicated by arrows in FIG. 5, FIG. 7 is a sectional view of a portion where a conductor press-clamping portion of the crimp terminal is crimped against a conductor of an electric wire, and FIG. 8 is an enlarged view of a main part of FIG. 3.

In a crimp terminal 10B, as is shown in FIGS. 5 to 8, a plurality of reinforcement concave-convex portions 40B of a limited size are formed at a root portion (a portion which is likely to be bent with a smallest curvature when the pair of conductor clamping pieces 32, 32 are crimped) of each of a pair of conductor clamping pieces 32, 32 of a conductor press-clamping portion 12B through press-working in which an inner surface side is formed into a pyramid-shaped projecting portion 46 and an outer side surface is formed into a pyramid-shaped depressed portion 47. The other features are completely the same as those of the crimp terminal of the first embodiment, and therefore, the same reference numerals will be given to the same constituent portions to those of the first embodiment, thereby omitting the description thereof.

When the conductor press-clamping portion 12B of the crimp terminal 10B is crimped against a conductor Wa of an electric wire W, the crimping of the conductor press-clamping portion 12B is implemented in completely the same way as done in the crimp terminal 10 of the first embodiment. By doing so, the conductor press-clamping portion 12B of the crimp terminal 10B can be connected to the conductor Wa of the electric wire W, whereby a crimp structure shown in FIG. 7 can be obtained.

According to the crimp terminal 10 which is crimped in the way described above and the crimp structure obtained by the crimp terminal 10, since the reinforcement concave-convex portions 40B are provided at the respective root portions of the left and right conductor clamping pieces 32, as with the first embodiment, the rigidities at the root portions of the conductor clamping pieces 32 can be increased, whereby the looseness of the crimped conductor clamping pieces 32 can be prevented that would otherwise be caused by a thermal shock test which is carried out in such a state that the left and right conductor clamping pieces 32 are crimped against the conductor Wa of the electric wire W, thereby making it possible to realize an increase in electrical connection property and an increase in mechanical connection property. In addition, since the construction to make that happen results only from providing the reinforcement concave-convex portions 40B of the limited size at the root portions of the conductor clamping pieces 32, the construction can be realized without changing the shape of the terminal largely.

In addition, since the clamping force exerted on the conductor Wa by the conductor clamping pieces 32 can be expected to increase (pressures are applied as indicated by arrows in FIG. 8) in the positions where the reinforcement concave-convex portions 40B are provided and where the shape of the crimp terminal 10B is changed locally when the conductor clamping pieces 32 are crimped against the conductor Wa, an increase in contact pressure exerted on the conductor Wa by the conductor clamping pieces 32 can be realized in this respect.

Incidentally, in the second embodiment, while the reinforcement concave-convex portions 40B are described as having been formed in advance in the crimp terminal 10B, since the reinforcement concave-convex portions 40B are obtained through press-working, it is possible to form the reinforcement concave-convex portions 40B in a stage of obtaining the crimp structure is obtained, that is, in a stage where the crimp terminal is crimped against the conductor. This becomes possible only with the reinforcement concave-convex portions 40B of the second embodiment in which the inner surface side of the conductor clamping piece 32 is formed into the projecting portion 46 and the outer surface side is formed into the depressed portion 47.

Figure 9:
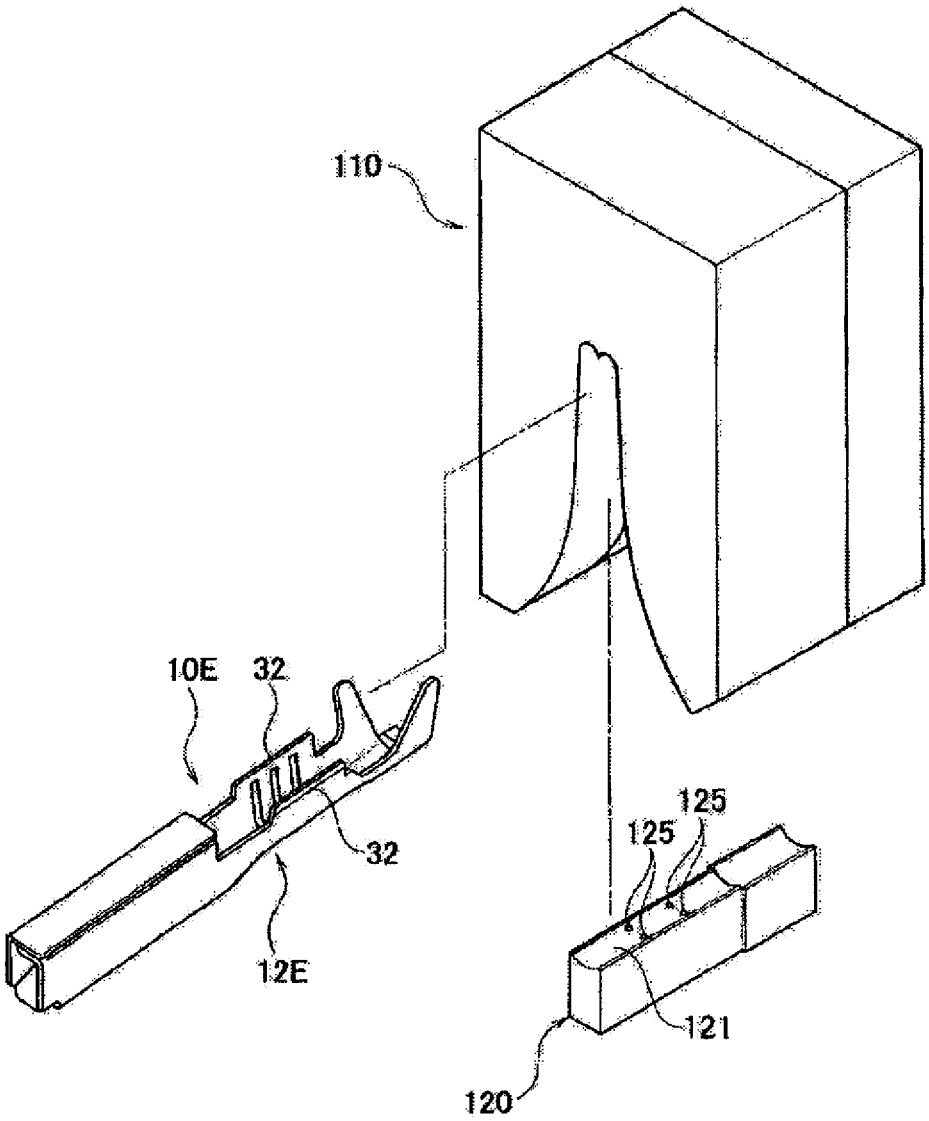
FIG. 9 is an explanatory view of a crimping method as a third embodiment of the invention.
Figure 10:
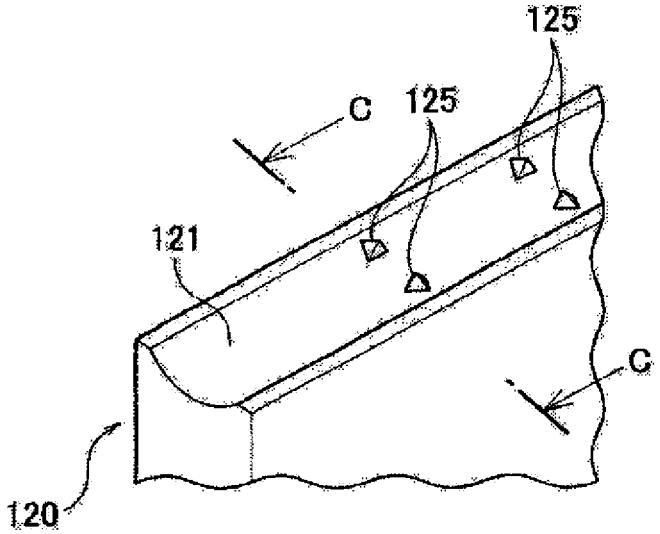
FIG. 10 is an enlarged perspective view of a main part of a lower mold.
Figure 11:
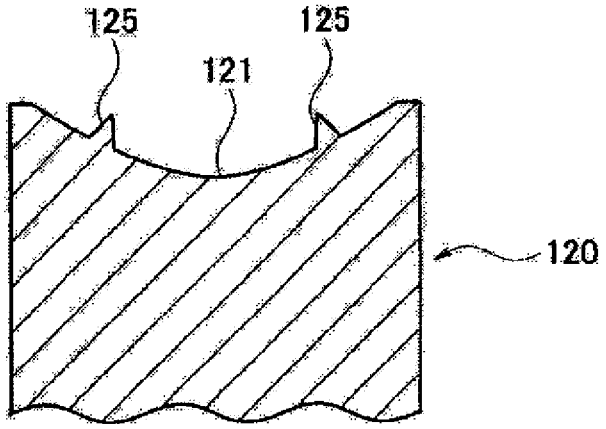
FIG. 11 is a sectional view taken along a line C-C and viewed in a direction indicated by arrows in FIG. 10.

FIG. 9 is an explanatory view depicting a crimping method when reinforcement concave-convex portions are formed in a crimping stage as proposed above, FIG. 10 is an enlarged perspective view of a main part of a lower mold in FIG. 9, and FIG. 11 is a sectional view taken along a line C-C and viewed in a direction indicated by arrows in FIG. 10.

Figure 12:
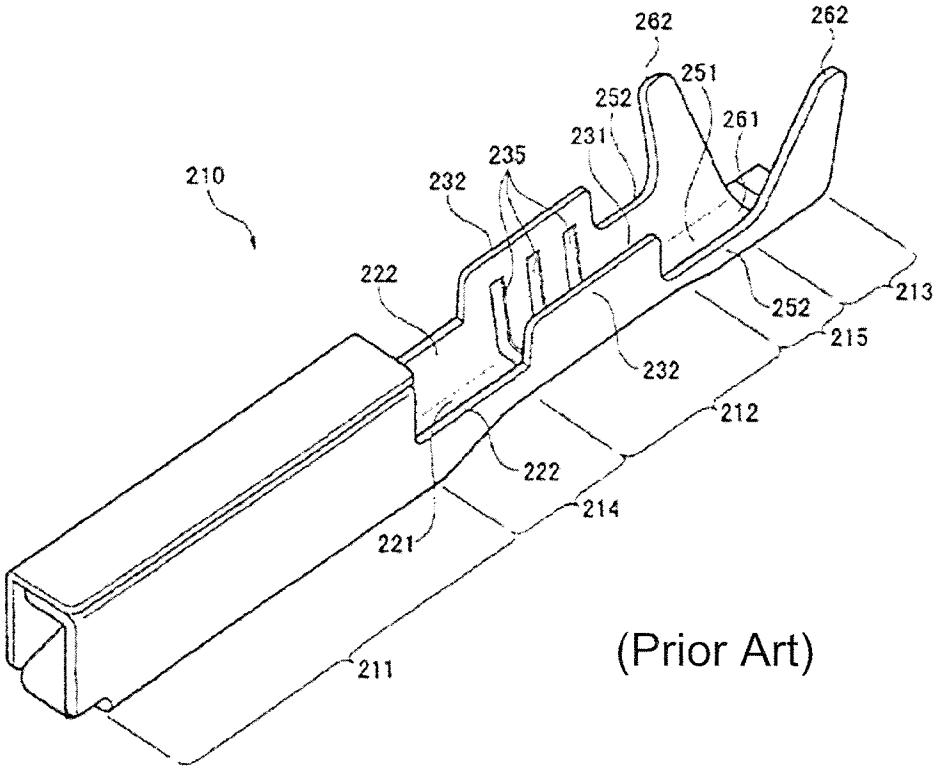
FIG. 12 is a perspective view showing the configuration of a crimp terminal in a related art.
Figure 13:
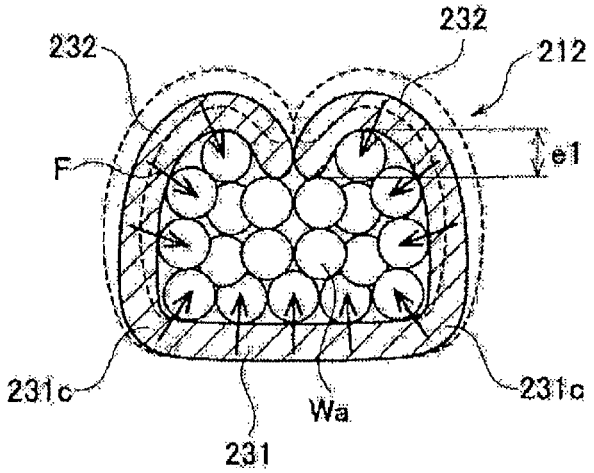
FIG. 13 shows sectional views showing a portion where a conductor press-clamping portion of the crimp terminal in the related art is crimped against a conductor of an electric wire, of which (a) shows a state in which the conductor press-clamping portion is crimped against the conductor and (b) shows a state in which the conductor press-clamping portion does not restore its original crimped shape completely after a thermal shock test.
Figure 13:
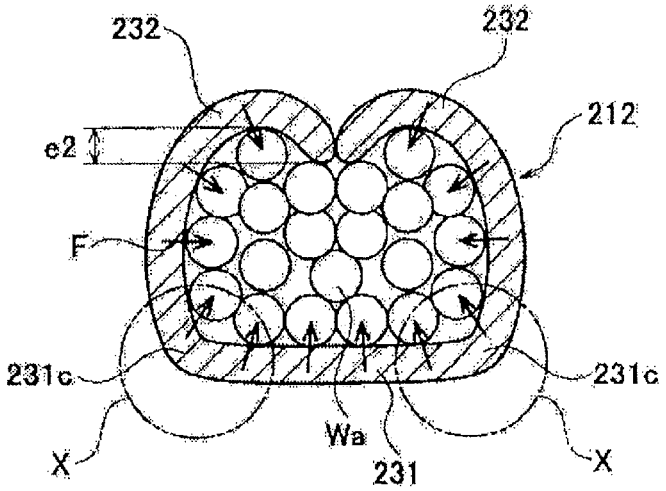

When this method is carried out, as is shown in FIG. 9, a crimp terminal 10E is used in which no reinforcement concave-convex portion is formed. Namely, this crimp terminal 10E corresponds to the crimp terminals 10, 10B shown in FIGS. 1 and 5, respectively, with the corresponding reinforcement concave-convex portions 40, 40B removed therefrom. For example, the crimp terminal in the related art shown in FIG. 12 can be used as it is.

Firstly, this crimp terminal 10E is placed on a placing surface 121 of a lower mold 120 of a crimping apparatus which has an upper mold 110 and the lower mold 120. In this case, as is shown in FIGS. 10 and 11, a plurality of projections 125 are provided on the placing surface 121 of the lower mold 120 to form reinforcement concave-convex portions.

Then, a conductor of an electric wire is inserted between a pair of left and right conductor clamping pieces 32, 32 of a conductor press-clamping portion 12E so as to be placed on an inner surface of a bottom plate 31. Then, by lowering the upper mold 110 relative to the lower mold 120 in that state, the pair of conductor clamping pieces 32, 32 are bent inwards to be crimped against the conductor Wa so as to wrap the conductor Wa, whereby the conductor press-clamping portion 12E is crimped against the conductor Wa.

Then, in a state where the conductor press-clamping portion 12E is crimped against the conductor of the electric wire, the reinforcement concave-convex portions 40B of the limited size can be formed through pressing by the projections 125 provided on the placing surface 121 of the lower mold 120 so as to project therefrom at the respective root portions of the pair of conductor clamping pieces 32, 32 as is shown in FIG. 7 at the same time as the conductor press-clamping portion 12E is crimped against the conductor of the electric wire.

In this way, according to the crimp method of the third embodiment, since the reinforcement concave-convex portions 40B are formed at the root portions of the conductor clamping pieces 32 not in the stage where the crimp terminal is fabricated but when the crimp terminal is crimped against the electric wire, even in the event that an existing crimp terminal is used, the rigidity at the root portions of the conductor clamping pieces 32 can be increased after the fabrication of the crimp terminal, whereby as with the second embodiment, the problem of looseness of the crimped conductor clamping pieces 32 due to the thermal shock test can be solved, thereby making it possible to realize an increase in electrical connection property and an increase in mechanical connection property.

In addition, since the reinforcement concave-convex portions 40B for reinforcement of the root portions of the conductor clamping pieces 32 are worked at the same time as the terminal is crimped against the conductor by use of the upper mold 110 and the lower mold 120, the reinforcement concave-convex portions 40B can easily be realized only by providing the projections 125 to form them on the lower mold.

In the respective embodiments, in addition to the conductor of the aluminum electric wire, a conductor of a copper electric wire may be used as a conductor of an electric wire that is connected to the crimp terminal.

While the invention has been described in detail and by reference to the specific embodiments, it is obvious to those skilled in the art to which the invention pertains that the invention can be altered or modified variously without departing from the spirit and scope of the invention.

This patent application is based on Japanese Patent Application (No. 2009-093145) filed on Apr. 7, 2009, the contents of which are incorporated herein by reference.

INDUSTRIAL APPLICABILITY

According to the first aspect of the invention, since the reinforcement concave-convex portions of the limited size are provided at the root portions of the conductor clamping pieces, the rigidity at the root portions of the conductor clamping pieces can be increased without changing the shape of the terminal largely. Because of this, the looseness of the crimped left and right conductor clamping pieces can be prevented which would otherwise be caused by the thermal shock test carried out thereon in such a state that the conductor clamping pieces are crimped against the conductor of the electric wire.

Namely, when a thermal shock test is carried out on the portion where the conductor clamping pieces of the crimp terminal are crimped against the conductor of the electric wire, in case the rigidity of the conductor press-clamping portion is slightly insufficient, the distal ends of the conductor clamping pieces do not restore their crimped shapes completely when they get back to the ordinary temperature condition, whereby there may occur a case where the distal ends of the conductor clamping pieces tends to be kept opened slightly or the biting of the distal ends of the conductor clamping pieces into the conductor becomes shallow. In particular, when the terminal material differs from the conductor material, causing a difference in thermal expansion therebetween, the above phenomenon tends to occur easily. Then, the clamping force exerted on the electric wire by the crimp terminal is reduced, thereby electric connection resistance being increased or mechanical joining strength being weakened.

In this respect, according to the first aspect of the invention, due to the rigidity of the conductor clamping pieces being reinforced by the addition of the reinforcement concave-convex portions, the looseness of the crimped conductor clamping pieces (that is, the phenomenon that the conductor clamping pieces do not restore their original crimped shapes completely, whereby the distal ends of the conductor clamping pieces tends not to be closed completely but to remain slightly opened or the biting of the distal ends of the conductor clamping pieces into the conductor becomes shallow) can be prevented which would otherwise be caused when the thermal shock test is carried out, thereby making it possible to realize an increase in electrical connection property and an increase in mechanical connection property.

In addition, since the clamping force exerted on the conductor by the conductor clamping pieces can be expected to increase in the positions where the reinforcement concave-convex portions of the limited size are provided when the conductor clamping pieces are crimped against the conductor, an increase in contact pressure exerted on the conductor by the conductor clamping pieces is realized in this respect, too.

According to the second aspect of the invention, since the reinforcement concave-convex portions of the limited size are provided at the root portions of the conductor clamping pieces which are crimped against the conductor, the rigidities at the root portions of the conductor clamping pieces are increased, whereby the looseness of the crimped conductor clamping pieces can be prevented. Consequently, as with the first aspect of the invention, it becomes possible to realize an increase in electrical connection property and an increase in mechanical connection property between the terminal and the conductor.

According to the third aspect of the invention, since the reinforcement concave-convex portions are formed at the root portions of the conductor clamping pieces not in the stage where the crimp terminal is fabricated but when the crimp terminal is crimped to the electric wire, even in the event that an existing crimp terminal is used, the rigidities at the root portions of the conductor clamping pieces can be increased after the fabrication of the crimp terminal, thereby making it possible to prevent the looseness of the crimped conductor clamping pieces by the thermal shock test carried out thereon. Consequently, as with the first aspect of the invention, it becomes possible to realize an increase in electrical connection property and an increase in mechanical connection property between the terminal and the conductor. In addition, since the reinforcement concave-convex portions to reinforce the root portions of the conductor clamping pieces are worked at the same time as the crimp terminal is crimped against the conductor by use of the upper mold and the lower mold, the provision of the reinforcement concave-convex portions can easily be realized only by providing the projections to form the reinforcement concave-convex portions on the lower mold.

REFERENCE SIGNS LIST

10, 10B, 10E: Crimp Terminal;
12, 12B, 12E: Conductor Press-clamping Portion;
31: Bottom Plate;
32: Conductor Clamping Piece;
40, 40B: Reinforcement concave-convex portion;
41, 47: Depressed Portion;
42, 46: Projecting Portion;
110: Upper Mold;
120: Lower Mold;
121: Placing surface;
125: Projection;
W: Electric Wire;
Wa: Conductor.

The invention claimed is:

1. A crimp terminal comprising:

a conductor press-clamping portion that has a substantially U-shaped cross section and is configured to be crimped against and connected to a conductor of an electric wire, the conductor press-clamping portion includes:

a bottom plate;

a pair of conductor clamping pieces which extend upwards from root portions thereof located at left- and right-hand edges of the bottom plate, the pair of conductor clamping pieces are configured to be crimped so as to wrap the conductor disposed on an inner surface of the bottom plate; and reinforcement concave-convex portions that are only formed at the respective root portions of the pair of conductor clamping pieces so that either:

(i) an inner surface side of the conductor clamping pieces has a depressed portion and an outer surface side of the conductor clamping pieces has a projecting portion, and the depressed portion and the projecting portion form a pyramid-shape; or (ii) the inner surface side of the conductor clamping pieces has a projecting portion and the outer surface side of the conductor clamping pieces has a depressed portion, and the projecting portion and the depressed portion form a pyramid-shape.

2. A crimp structure of a crimp terminal comprising:

a conductor press-clamping portion that has a substantially U-shaped cross section and is configured to be crimped against and connected to a conductor of an electric wire, the conductor press-clamping portion includes:

a bottom plate;

a pair of conductor clamping pieces which extend upwards from root portions thereof located at left- and right-hand edges of the bottom plate, the crimp structure is configured so that the conductor press-clamping portion is crimped against the conductor by disposing the conductor on an inner surface of the bottom plate and bending the pair of conductor clamping pieces inwards to crimp them against the conductor so as to wrap the conductor; and reinforcement concave-convex portions that are only formed at the respective root portions of the pair of conductor clamping pieces so that either:

(i) an inner surface side of each of the conductor clamping pieces has a depressed portion and an outer surface side of each of the conductor clamping pieces has a projecting portion, and the depressed portion and the projecting portion form a pyramid-shape; or (ii) the inner surface side of each of the conductor clamping pieces has a projecting portion and the outer surface side of each of the conductor clamping pieces has a depressed portion, and the projecting portion and the depressed portion form a pyramid-shape.

3. A crimping method for crimping a crimp terminal using a crimping apparatus having a lower mold and an upper mold, the crimping method comprising:

placing the crimp terminal on a placing surface of the lower mold of the crimping apparatus, the crimp terminal including a conductor press-clamping portion that has a substantially U-shaped cross section and includes a bottom plate and a pair of conductor clamping pieces which extend upwards from root portions thereof located at left- and right-hand edges of the bottom plate;

placing a conductor, which is at an end of an electric wire, on an inner surface of the bottom plate so that the conductor is between the pair of conductor clamping pieces;

crimping the conductor press-clamping portion against the conductor by using the upper mold and the lower mold to bend the pair of conductor clamping pieces inwards and crimp them against the conductor; and forming, by press-working the root portions with projections projected on the placing surface of the lower mold and at a same time as crimping the conductor press-clamping portion of the crimp terminal against the conductor, reinforcement concave-convex portions only at the respective root portions of the pair of conductor clamping pieces so that each of the root portions has a projecting portion and a depressed portion that form a pyramid-shape and are respectively formed in an inner surface side and an outer surface side of each of the conductor clamping pieces.

* * * * *